United States Patent [19]

Plate

[11] 3,947,021

[45] Mar. 30, 1976

[54] BAG REMOVING APPARATUS

[75] Inventor: Gary G. Plate, Burlington, Canada

[73] Assignee: A.T.R. Equipment Industries Ltd., Mississauga, Canada

[22] Filed: Feb. 7, 1975

[21] Appl. No.: 548,123

[52] U.S. Cl. ..... 271/182; 271/69; 271/80

[51] Int. Cl.[2] ..... B65H 29/22; B65H 29/68

[58] Field of Search ..... 271/80, 69, 182, 203, 202, 271/183, 199, 176; 198/76

[56] References Cited

UNITED STATES PATENTS

| | | | |
|---|---|---|---|
| 3,507,489 | 4/1970 | Wilshin et al. | 271/182 |
| 3,722,376 | 3/1973 | Wech | 271/270 X |
| 3,827,545 | 8/1974 | Buhayar | 271/203 X |

*Primary Examiner*—John J. Love
*Assistant Examiner*—Bruce H. Stoner, Jr.
*Attorney, Agent, or Firm*—Arne I. Fors

[57] ABSTRACT

An improved discharge apparatus for facilitating the removal and stacking of finished bags from a bag-making machine. An adjustable speed control means is operable to impart selective rotational velocity to a pair of opposed stacking wheels between which bags are travelling as they are discharged from the machine. Timing means operatively connected to the stacking wheels cause the speed control means to operate for a fraction only of the time interval of discharge of each bag.

1 Claim, 2 Drawing Figures

BAG REMOVING APPARATUS

BACKGROUND OF THE INVENTION

This invention relates to a bag-making machine for fabricating bags from thermoplastic material of tubular flexible feed stock. More particularly the invention relates to an improved discharge apparatus for facilitating the removal and stacking of finished bags from a bag-making machine.

It is known to form bags from tubular feed stock of thermoplastic material such as polyethylene or polypropylene by advancing a flattened tube of the stock downstream to a station at which the opposed sides of the stock are sealed together by the application of heat and pressure. Concurrently with the sealing operation, the stock is cut adjacent the seal for severing each formed bag from stock upstream of the station. The finished bags are then discharged from the station and are projected across a gap to a stacking table by means of stacking wheels alone or in combination with opposed conveyor belts disposed intermediate the said station and stacking wheels.

In order to ensure that a continuous uninterrupted stream of newly formed bags are projected by the discharge apparatus onto the stacking table, precise control over the operation of the apparatus is desirable. The discharge apparatus should be precisely timed to operate immediately or shortly after the sealing and cutting operations to ensure a satisfactory rate of throughput of feed stock and discharge of newly formed bags. The discharge apparatus should also operate for a sufficient length of time to accelerate each newly formed bag away from the machine and the manner in which the bags are accelerated by the discharge means should be such that the bags, when they reach the stacking table, are arranged in condition for immediate packaging. Since the bags are quite limp they must be corrugated by the stacking wheels and ejected with sufficient momentum that they reach the stacking table in a flattened state. The bags must not, however, be ejected so rapidly that they overshoot the stacking table or they do not stack properly on the table and their discharge velocity must, therefore, be decelerated near the end of their travel.

Satisfactory operation of the discharge apparatus thus requires control over the correct timing of the apparatus in relation to the timing of the sealing-cutting apparatus, control over the length of time that the device is operative in each cycle and control over the velocity to which the newly formed bags are accelerated and from which they are decelerated by the apparatus. Few known devices provide means by which such control can be achieved and still fewer provide means whereby such control can be made while the bag-making machine is in operation.

It is the principal object of the present invention to provide a discharge apparatus for a bag-making machine having means permitting precise control over the velocity to which newly formed bags are discharged by the apparatus. Other objects of the invention ancillary to this object are a discharge apparatus having means for controlling the timing of the apparatus relative to the sealing-cutting cycle, and means for controlling the operation of the discharge apparatus during the said cycle.

It is another object to provide a discharge control means which may be operated while the bag-making machine is in operation whereby adjustments may be made in the discharge apparatus to ensure a continuous stream of bags to the stacking table without the necessity of shutting down the machine.

Another object is to provide control means which may be used in conjunction with most bag-making machines with only minor adjustments and which comprises only a small number of known and readily available components.

SUMMARY OF THE INVENTION

These and other objects may be accomplished by an improvement to the discharge means of a bag-making machine. In a bag-making machine having a prime mover in which successively formed bags are discharged sequentially from the machine, the improvement comprising a pair of opposed stacking wheels for gripping said formed bags therebetween as they are discharged from the machine; adjustable speed control means operable to impart selective rotational velocity to said stacking wheels for slowing each of said discharing bags near the completion of its discharge; and timing means operatively connected to said prime mover for causing said speed control means to operate for a fraction only of the time interval of discharge of each bag.

BRIEF DESCRIPTION OF THE DRAWINGS

Other objects of the invention and the manner in which they can be achieved will become apparent from the following detailed description of the drawings in which.

Like reference characters refer to the like parts throughout the description of the drawings.

DESCRIPTION OF THE PREFERRED EMBODIMENT

Figure 1:
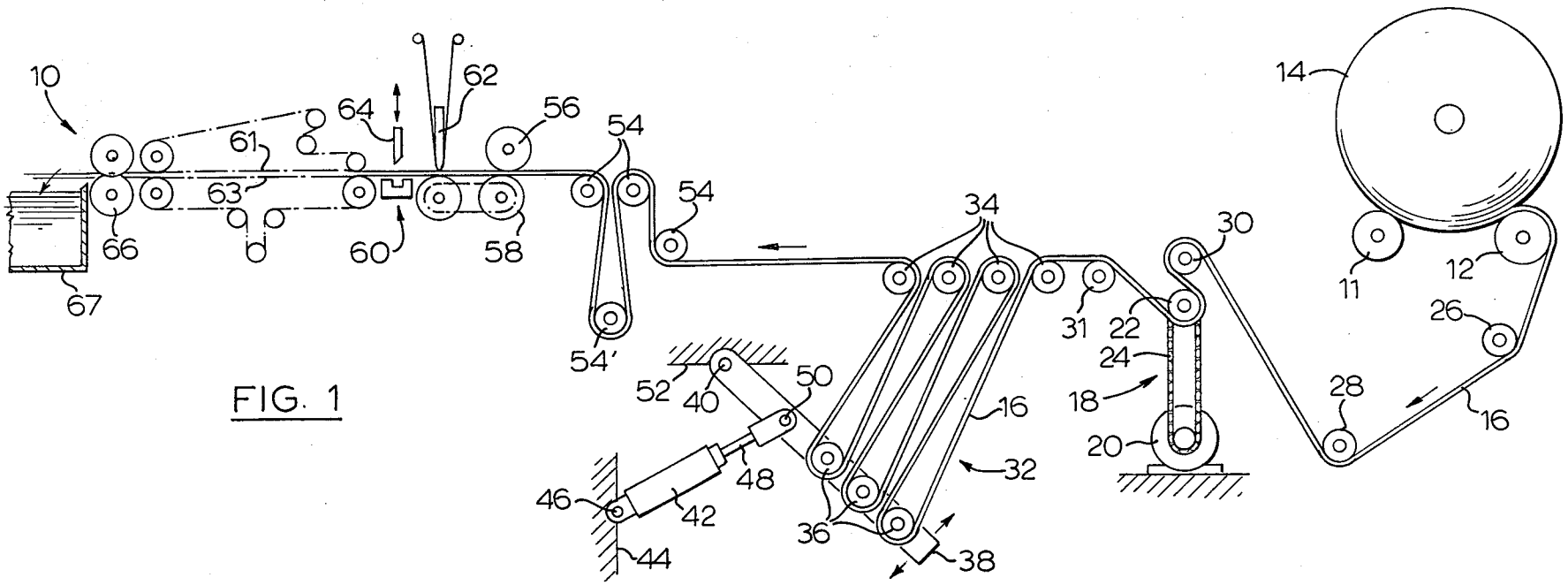
FIG. 1 is a schematic view of a known bag-making machine showing the general arrangement of component parts.

With reference first to FIG. 1, the improved discharge means indicated generally by numeral 10 is incorporated in a bag-making machine which comprises a pair of surface unwind rollers 11, 12 upon which a roll of feed stock 14 is seated for rotation as tubular material 16 in flattened form is drawn therefrom. Tubular stock 14 will be of a flexible, thermoplastic material having the heat sealing characteristics of polyethylene or polypropylene.

The capstan drive designated generally by numeral 18 comprises a drive motor 20 operatively connected to rubber-covered drive roller 22 by a chain 24. Capstan 18 draws feed stock 16 from roll 14 by way of idler rollers 26, 28 and 30, the latter roller arranged in conjunction with idler roller 31 relative to drive roller 22 as shown or in abutment with drive roller 22 to provide a satisfactory wrap about drive roller 22 to avoid slippage of feed stock thereon.

The compensator designated generally by numeral 32 comprises a plurality of idler rollers 34 journaled for rotation in a fixed position and a plurality of idler rollers 36 journaled for rotation on arm 38 mounted for pivotal movement by pin 40 at one end thereof. Single-acting pneumatic cylinder 42 connected at one end to support wall 44 by pivot pin 46 and having a piston and rod assembly 48 slidably mounted therein and pivotally connected at the other end to arm 38 by pivot pin 50 is adapted to bias arm 38 in a downward, clockwise position as viewed in FIG. 1 for maintaining stock 16 under tension. Air under about 10 p.s.i.g. pressure, for example, is introduced to cylinder 42 to maintain a constant and uniform pressure on arm 38 regardless of its position.

It will be understood that a tension spring can be used in place of pneumatic cylinder 42 to maintain a pressure on arm 38. However, a pneumatic cylinder has the advantage over a spring in that the force exerted on arm 38 will be uniform as determined by the pneumatic pressure in the cylinder whereas the pressure exerted by a tension spring will vary as the length of the spring is extended or decreased.

Operatively connected to arm 38 and not shown is a limit control which measures the angle defined between arm 38 and a reference plane, such as, for example, between arm 38 and support wall 52. The control is operatively connected electrically to capstan drive motor 20 whereby upward, counter-clockwise movement of arm 38 will result in capstan drive 18 increasing in speed to draw an increased amount of stock from roller 14 such that arm 38 will return to its normal position as shown schematically in FIG. 1. As arm 38 reaches a predetermined angle of inclination, drive 20 slows down and/or is stopped; constant tension being maintained on stock 16 at all times by pneumatic cylinder 42.

A plurality of idler rollers 54 are located intermediate compensator 32 and draw rollers 56, 58 to permit inclusion of a perforating device in the system if desired. Idler roller 54' is adjustably mounted to facilitate incorporation of a perforating device.

The pair of draw rollers 56, 58 is located immediately before sealing bar-knife section 60; sealing bar 62 and knife 64 being adapted for vertical reciprocal movement. Stacking wheels 66, to be described in more detail below, can be disposed adjacent sealing-cutting assembly 60 for discharging finished bags from the machine, or can be spaced from sealing-cutting assembly 60 with opposed conveyor belts 61, 63 disposed therebetween, as illustrated, for discharge onto stacking table 67.

Although not shown, it will be understood that the foregoing rollers are journaled for rotation and the pivot pins mounted in a rigid steel framework.

Each of the components of the bag-making machine mentioned above are well-known in the art and are described in numerous publications. U.S. Pat. No. 3,673,879, for example, describes a particularly suitable sealing-cutting assembly and drive assembly for draw rollers 56, 58.

Figure 2:
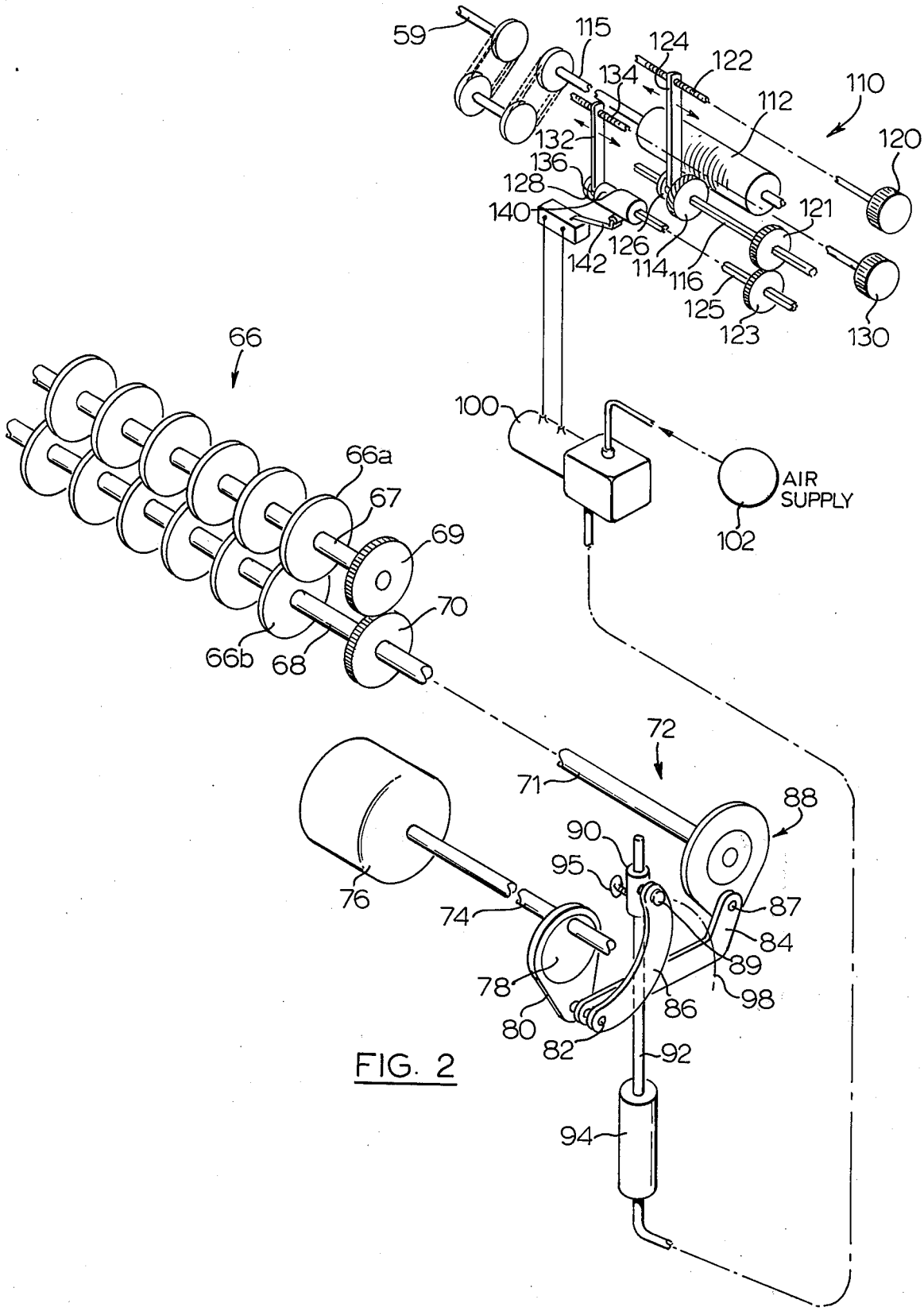
FIG. 2 is an exploded perspective view of the discharge apparatus of the invention together with a schematic view of known sealing-cutting apparatus.

FIG. 2 illustrates the components of the stacking wheels control mechanism according to the subject invention as well as a schematic representation of the sealing-cutting assembly. With reference to the figure, the sealing-cutting assembly designated by numeral 60 serves, in a known manner, to heat and pressure seal together the opposed flattened tube of feed stock 16 (FIG. 1) to form a bag bottom while substantially concurrently cutting the stock adjacent the seal for severing each formed bag from the stock. A particularly suitable sealing-cutting assembly is shown and described in the above-mentioned U.S. patent which is incorporated herein by reference. The sealing cutting assembly 60 is, as is well known in the art, adapted for reciprocal cyclical movement and is activated by the machine main drive shaft 59, i.e. prime mover.

Stacking wheels **66*a*, 66*b* are keyed to shaft 67, 68 respectively and the shafts in turn are geared to rotate together by mating spur gears 69, 70. Shaft 68 is driven continuously in a counter-clockwise direction as viewed in the Figure by out-put shaft 71 of a variable speed drive, indicated generally by numeral 72.** The latter device may take various forms all of which being well known in the art. The illustrated device, which is commercially available and is identified by the registered trade mark ZERO-MAX, is found particularly suitable for purposes of the present invention.

The illustrated variable speed drive 72 consists of an input shaft 74 which is driven at a constant speed by, for example, electric motor 76 and which supports a plurality of axially spaced eccentrics 78, one of which is shown. A connecting rod 80 is rotatably mounted on each eccentric 78 and is pivotably connected at its lower end to pintle 82. A main link 84 and a control link 86 are also pivotally connected to pintle 82.

The end of main link 84 opposite pintle 82 is connected by pivot pin 87 to an overrrunning clutch generally indicated by numeral 88 which converts the linear motion of link 84 into rotary motion and which drives output shaft 71. The end of control link 86 opposite pintle 82 is joined by pivot pin 89 to a sleeve 90 which is mounted about piston rod 92 of a pneumatic actuator 94. A thumb screw 95 permits adjustment of the position of sleeve 90 on the piston rod.

The position of the end of control link 86, adjacent pin 89, may swing through arc 98 under the action of actuator 94 and its position on the arc governs the rate at which output shaft 71 rotates. Where the end of the control link is at its lowest point on the arc, main link 84 pivots at a reduced desired speed, e.g. about 1/2 speed. As the end of the control limb swings upwardly on arc 98 to the illustrated position, the direction of throw of connecting rods 80 alters from vertical to horizontal thereby varying the length of the strokes main link 84 delivers to clutch 88, increasing the speed to the pre-set speed.

By the use of four or more overrunning clutches 88 and by driving them from eccentrics 78 successively, output shaft 71 rotates continuously.

An electrically operated valve 100 controls the supply of compressed air from an air compressor 102 to pneumatic actuator 94. When the valve is closed, the position of the piston rod 92 is retracted under the bias of a spring or other means mounted in the actuator and reduced rotary motion is imparted to output shaft 71 by main link 84. When the valve is opened, the piston rod is caused to move outwardly of the actuator to the illustrated position and the upper end of control link 86 swings to a position at which increased rotational speed to pre-set r.p.m. is imparted to the output shaft.

When valve 100 is open, the rate of rotation of the output shaft will, of course, depend upon the position to which the control link 86 is moved by the piston rod. By means of thumb screw 95, this position can be adjusted thereby permitting selection of the speed imparted to output shaft 71 when the valve is open.

Valve 100 is actuated by a switch, indicated generally by the numeral 110, which periodically opens and closes the said valve. Switch 110 is activated, for example, by sprockets from the main drive shaft determining the production rate of severed bags through the stacking wheels. The switch is provided with means for adjusting the relative length of time during each operating cycle of the stacking wheels that the switch is closed and is also provided with means for adjustment of when the "closed" period of the switch occurs in relation to the operating cycle of the sealing-cutting assembly, said means to be described hereinbelow. The illustrated device is commercially available and is identified by the trade mark CANDY/SWITCH.

Switch 110 comprises a pair of mating helical gears 112, 114, the former gear 112 constituting the driving gear and being keyed to shaft 115 which is driven at a constant speed by the machine main drive shaft. The latter driven gear 114 is slidably mounted to a freely rotatable hexagonal shaft 116 journaled in the switch housing (shown by dashed lines).

The position of gear 114 on shaft 116 may be adjusted by rotation of a knob 120 mounted externally of the housing as follows: the knob is connected to an externally threaded shaft 122 which is journaled in the housing, and about which an internally threaded slider 124 is positioned. The lower end of the slider is accommodated in an annular groove 126 at one end of driven gear 114. As the knob is rotated, the slider moves along shaft 122 and causes a corresponding axial movement of driven gear 114 along hexagonal shaft 116.

A driving spur gear 121 is keyed to hexagonal shaft 116 and mates with a driven spur gear 123 keyed to hexagonal shaft 125. The latter shaft is disposed parallel to shaft 116 and is journaled for rotation in the housing. A cam 128 is slidably mounted about hexagonal shaft 125 and its position on the shaft may, in a manner similar to helical gear 114, be axially adjusted by rotation of externally mounted knob 130. Thus rotation of the latter knob causes a slider 132 to move along a threaded shaft 134. The lower end of the slider is accommodated in an annular groove 136 formed in the cam and movement of the slider causes a corresponding movement of the cam along hexagonal shaft 125.

Cam 128 is provided with an uniformly increasing rise 140 along which cam follower 142 runs. The follower is spring biased against the cam and when the follower is urged downwardly by cam rise 140 it closes the electrical circuit which energizes valve 100.

The operation of this control mechanism for stacking wheels 66 is as follows: the stacking wheels 66*a*, 66*b* are rotated at a desired pre-set speed until an impulse from switch 110 opens valve 100 thereby activating pneumatic cylinder 94 of the variable speed drive 72. Upon activation of the cylinder 94, the end of control link 86 which is connected to the piston rod of the cylinder swings downwardly and rotary motion of output shaft 71, and hence to stacking wheels 66, is reduced to about one-half of the pre-set, desired speed. The rotational velocity imparted to the output shaft will vary both with the speed of electric motor 76, as desired, and with the depression of the control link when the piston rod is retracted. The amptitude of the latter variable can be adjusted by means of thumb screw 95.

An impulse from switch 110 is generated when cam follower 142 is forced downward by cam rise 140. The follower 142 is forced downwardly during each revolution of the cam and the interval of time during each complete revolution of the cam that the follower is forced downwardly can be varied by rotation of knob 130. This is because rotation of the knob causes the position of the cam on shaft 125 to shift with resulting change in the extent of the cam rise in contact with the roller during each cycle of the cam. Thus knob 130 permits adjustment of the time during which the stacking wheels 66 are rotating at the desired pre-set speed in relation to the time during which they are rotating at the reduced speed.

By means of knob 120, the time of slowdown of commencement of rotation of the stacking wheels during the operating cycle of the sealing-cutting assembly can be adjusted. Rotation of the latter knob causes helical gear 114 to shift on its shaft 116 and a rotary motion is imparted to shaft 116 relative to shaft 115 with resulting change in the phase relationship between the two shafts.

It will be understood, of course, that modifications can be made in the preferred embodiments of the present invention as described hereinabove without departing from the scope and purview of the appended claims.

What we claim as new and desire to protect by Letters Patent of the U.S. is:

1. In a bag-making machine having a prime mover in which successively formed bags are discharged sequentially from the machine, the improvement comprising a pair of opposed stacking wheels for gripping said formed bags therebetween as they are discharged from the machine; adjustable speed control means operable to impart selective rotational velocity to said stacking wheels for slowing each of said discharging bags near the completion of its discharge; timing means operatively connected to said prime mover for causing said speed control means to operate for a fraction only of the time interval of discharge of each bag; means for adjusting the instant of commencement of activation of said timing means by the prime mover during said time interval; and means for adjusting the duration of activation of said timing means by the prime mover during said time interval.

* * * * *